US011825967B2

(12) United States Patent
van der Wath

(10) Patent No.: US 11,825,967 B2
(45) Date of Patent: Nov. 28, 2023

(54) ADJUSTER FOR ADJUSTING THE VOLUME OF A RECEPTACLE

(71) Applicant: Carolus Johannes Christiaan van der Wath, Pretoria (ZA)

(72) Inventor: Carolus Johannes Christiaan van der Wath, Pretoria (ZA)

( * ) Notice: Subject to any disclaimer, the term of this patent is extended or adjusted under 35 U.S.C. 154(b) by 698 days.

(21) Appl. No.: 15/733,477

(22) PCT Filed: Aug. 23, 2018

(86) PCT No.: PCT/ZA2018/050047
§ 371 (c)(1),
(2) Date: Aug. 6, 2020

(87) PCT Pub. No.: WO2019/157538
PCT Pub. Date: Aug. 15, 2019

(65) Prior Publication Data

US 2021/0100384 A1 Apr. 8, 2021

(30) Foreign Application Priority Data

Feb. 7, 2018 (ZA) ..... 2018/00788

(51) Int. Cl.
*A47G 21/00* (2006.01)
*B65D 65/46* (2006.01)
*B65D 83/00* (2006.01)

(52) U.S. Cl.
CPC ..... *A47G 21/001* (2013.01); *B65D 65/466* (2013.01); *B65D 83/0005* (2013.01)

(58) Field of Classification Search
CPC ..... B65D 1/44; B65D 2501/24547; B65D 21/086; B65D 65/466; B65D 83/0005; A47G 21/001
See application file for complete search history.

(56) References Cited

U.S. PATENT DOCUMENTS 169,923 A * 11/1875 Roman ..... A24F 27/04 206/250
693,621 A * 2/1902 Rapaport ..... A47F 1/06 221/227
1,958,524 A * 5/1934 Tooker ..... A45D 40/10 401/62
2,583,961 A * 1/1952 Nash ..... A45C 11/328 59/79.1
2,589,000 A * 3/1952 Vani ..... A47G 21/005 401/12
3,989,392 A * 11/1976 Seidler ..... B43K 21/08 401/84

(Continued)

FOREIGN PATENT DOCUMENTS

BE 1007737 A6 10/1995
DE 10 2010 024 092 A1 12/2010
WO 01/28873 A1 4/2001

*Primary Examiner* — Kareen K Thomas
(74) *Attorney, Agent, or Firm* — Lippes Mathias LLP

(57) ABSTRACT

An adjuster for adjusting the volume of a receptacle which includes a floor dimensioned to be complementary received by the receptacle, and, a displacement mechanism for displacing the floor relative the receptacle, wherein the volume of the receptacle is adjusted when actuating the displacement mechanism thereby displacing the floor relative the receptacle.

21 Claims, 5 Drawing Sheets

(56) References Cited

U.S. PATENT DOCUMENTS

| | | | | |
|---|---|---|---|---|
| 5,421,663 | A * | 6/1995 | Bravo | A47G 19/303 222/391 |
| 6,056,164 | A * | 5/2000 | Wakayama | B65D 83/0005 222/386 |
| 6,779,664 | B1 | 8/2004 | Bermann | |
| 8,342,764 | B2 * | 1/2013 | Bonneyrat | A45D 40/02 401/179 |
| 8,596,457 | B1 | 12/2013 | Goblirsch et al. | |
| 10,327,532 | B2 * | 6/2019 | Li | A45D 40/205 |
| 11,571,077 | B1 * | 2/2023 | Solis | A47G 21/001 |

* cited by examiner

ADJUSTER FOR ADJUSTING THE VOLUME OF A RECEPTACLE

This application is a National Stage Entry of International Application No. PCT/ZA2018/050047, filed Aug. 23, 2018, and entitled "AN ADJUSTER FOR ADJUSTING THE VOLUME OF A RECEPTACLE"; which claims priority to South African Application No. 2018/00788, filed Feb. 7, 2018, and entitled "AN ADJUSTER FOR ADJUSTING THE VOLUME OF A RECEPTACLE", the contents of which are incorporated by reference herein.

TECHNICAL FIELD

The invention relates to an adjuster for adjusting the volume of a receptacle, and a receptacle having an adjustable volume.

BACKGROUND

Consuming fast food items such as sausage rolls, hot dog roll, wraps or the like is usually a messy experience. One of the problems associated with the consuming of fast food items is that the volume of the fast food receptacle does not decrease as the item is consumed. The result is that the packaging usually has to be teared or folded away to get to the next bite.

Packaging of the kind are usually also manufactured from a non-recyclable material which pose a pollution problem especially in cities where fast food are sold around every corner.

The inventor having considered the above proposes the invention described hereunder.

SUMMARY OF INVENTION

According to the invention there is provided an adjuster for adjusting the volume of a receptacle which includes:

- a floor dimensioned to be complementary received by the receptacle; and
- a displacement mechanism for displacing the floor relative the receptacle;
- wherein the volume of the receptacle is adjusted when actuating the displacement mechanism thereby displacing the floor relative the receptacle.

The receptacle may be circular shaped in top view. The receptacle may be oval shaped in top view. The receptacle may be manufactured from a biodegradable, compostable and/or recyclable material which may include starch and/or a derivative thereof.

The receptacle may be resiliently deformable.

The receptacle may include a bottom portion for sealing off the bottom end of thereof.

The floor may have an outer circumference shaped and sized to allow the floor to fit snugly inside the receptacle.

The floor may include a food receiving zone defined onto an upper facing surface thereof. The food receiving zone may be corrugated and/or serrated.

The floor may include a stabiliser for inhibiting angular movement relative a vertical axis thereof when displacing the floor relative the receptacle. The stabiliser may be in the form of a flange extending circumferentially about the floor and extending downward therefrom.

The displacement mechanism may be configured to allow linear displacement of the floor relative the receptacle.

The displacement mechanism may be configured to, when actuated, to displace the floor towards an upper end region of the receptacle for decreasing the volume thereof.

The displacement mechanism may include a pair of arms and a biasing mechanism for biasing the arms towards an extended outward position.

In one form of the invention the pair of arms may be pivotally connected to the floor, opposedly one another and pivoting about a pair of pivot points defined by a connecting arrangement interconnecting the displacement mechanism and the floor. The pair of pivot points may include a pair of shafts defined on the connecting arrangement, and a bore defined on an end region of each arm for pivotally mounting the arms onto the shafts, respectively.

The displacement mechanism may further include a synchronising mechanism for synchronising the degree of pivotal displacement of one arm relative another arm when actuated.

In one form of the invention the synchronising mechanism may be in the form of a cogwheel type formation defined on opposing end regions of each arm about the pivot points, wherein the pair of shafts are arranged so as to allow the cogwheel type formation of one arm to mesh with the cogwheel type formation of the other arm.

The meshing arrangement of the cogwheel type formations enables each of the pair of arms, when actuated, to be displaced in unison or synchronously relative one other, thereby promoting an even degree of displacement of opposing sides of the floor so as to maintain all sides of the floor in a substantial orthogonal relationship relative the receptacle, when in operative mode.

In another form of the invention the synchronising mechanism may include a linear geared shaft extending downward from the connecting formation, wherein the cogwheel type formation of each arm is arranged to operatively interconnect with the linear geared shaft. In this form of the invention actuating the arms pushes the linear geared shaft in an upward direction, displacing the floor and reducing the volume of the receptacle.

A biasing mechanism is further provided for biasing the arms outward towards an outward extended condition wherein distally defined operative surfaces of the arms abut against the inner surface of the receptacle.

The biasing mechanism may be in the form of a spring-loaded plate, coil spring, elastic band, or the like mounted onto the arms so as to extend towards an outward direction.

The biasing mechanism may be mounted so as to interconnect upper end regions of the arms.

The biasing mechanism may be mounted so as to interconnect lower end regions of each arm with the connecting formation, respectively.

The biasing mechanism may further be mounted so as to interconnect lower end regions of the arms.

The arms are further arcuated shaped in side view so as to allow operative surfaces thereof to remain in contact with the receptacle when the arms are actuated towards an inclined position towards one another.

The operative surface may include serrations.

DETAILED DESCRIPTION OF THE INVENTION

Figure 1:
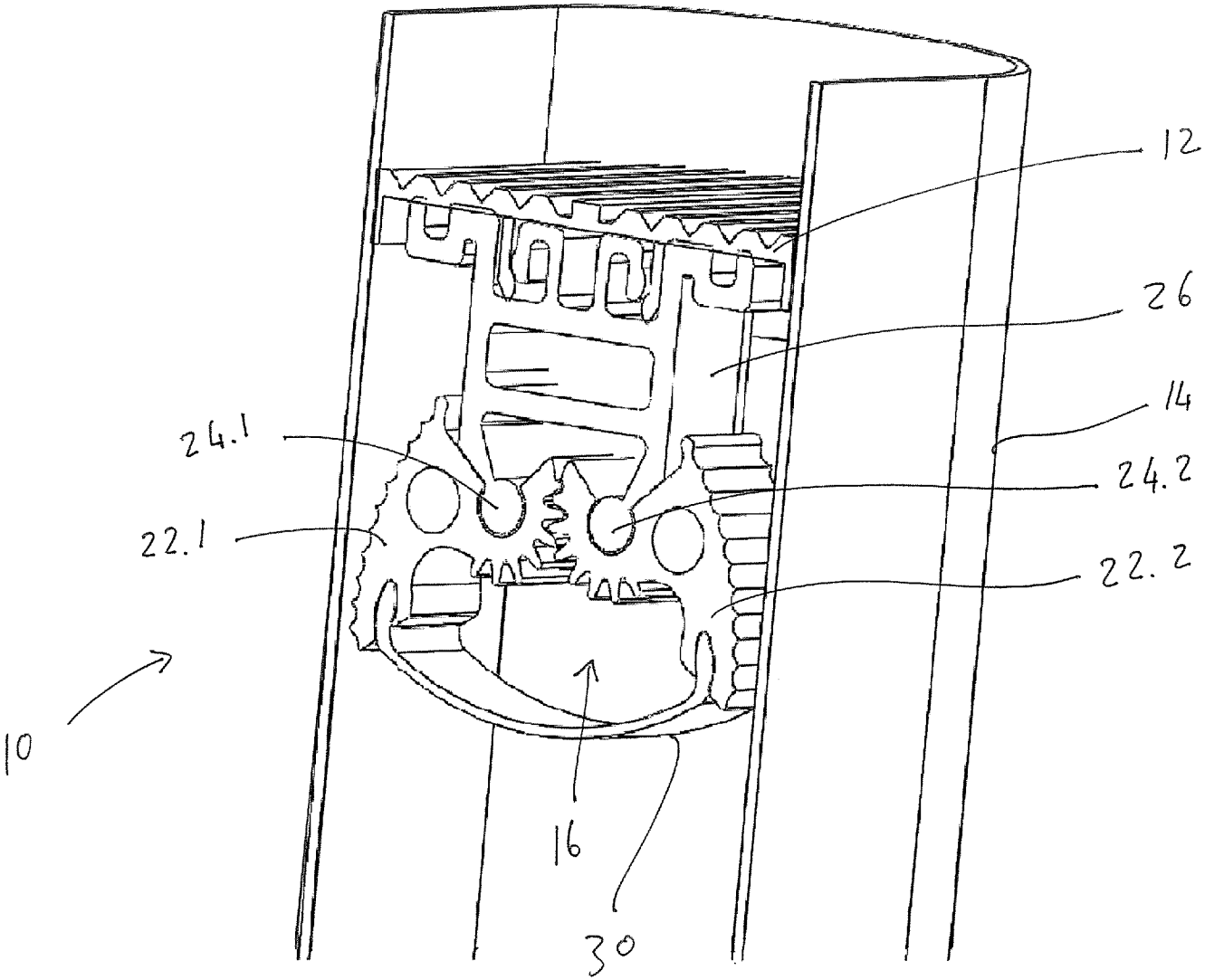
FIG. 1 is a cut view of a first embodiment of the adjuster.

The invention will now be described by way of the following, non-limiting example with reference to the accompanying drawings wherein reference numeral 10 generally refers to a first embodiment of the adjuster for adjusting the volume of a receptacle.

Figure 2:
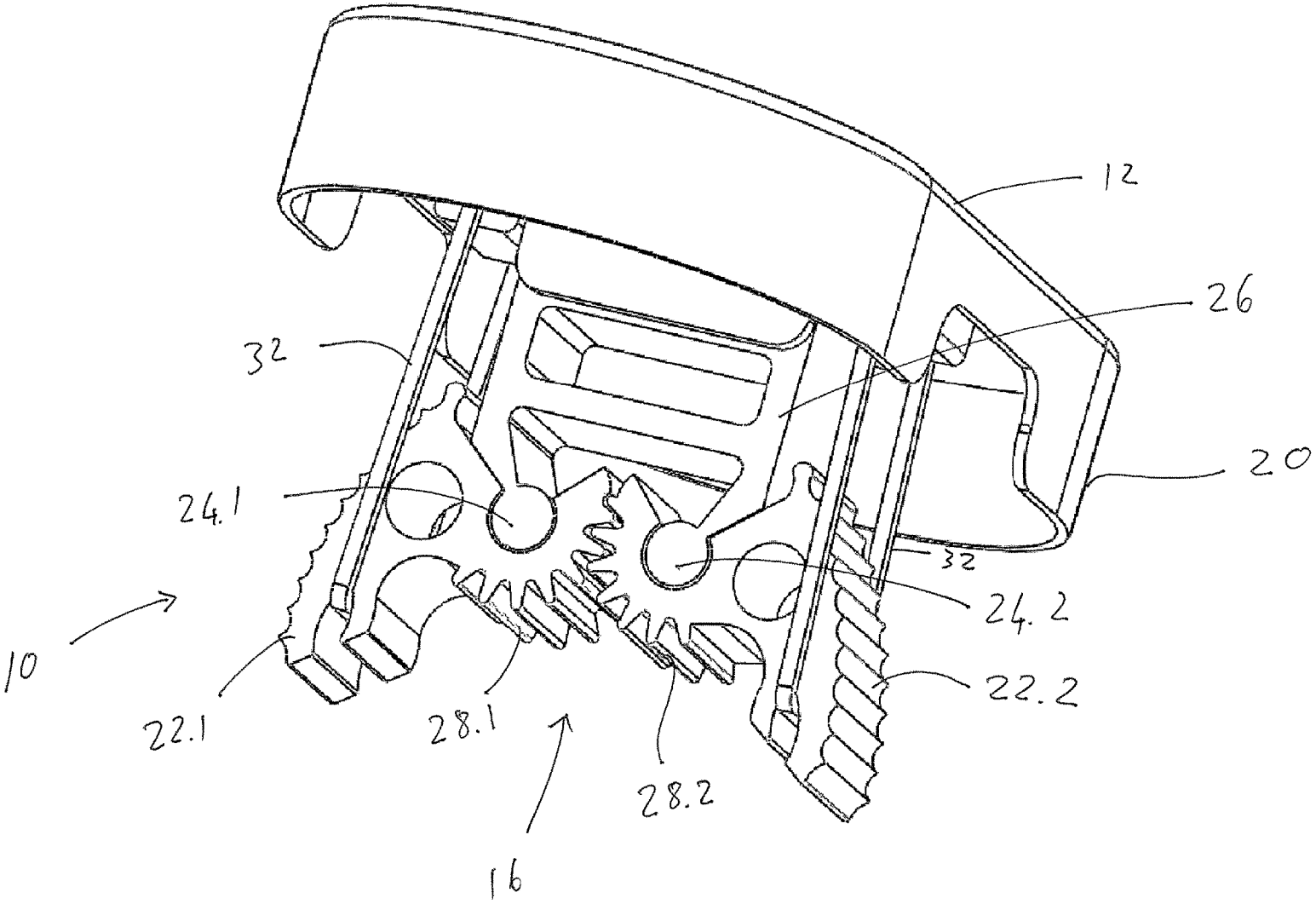
FIGS. 2 is a bottom perspective view of the adjuster shown in FIG. 1.
Figure 3:
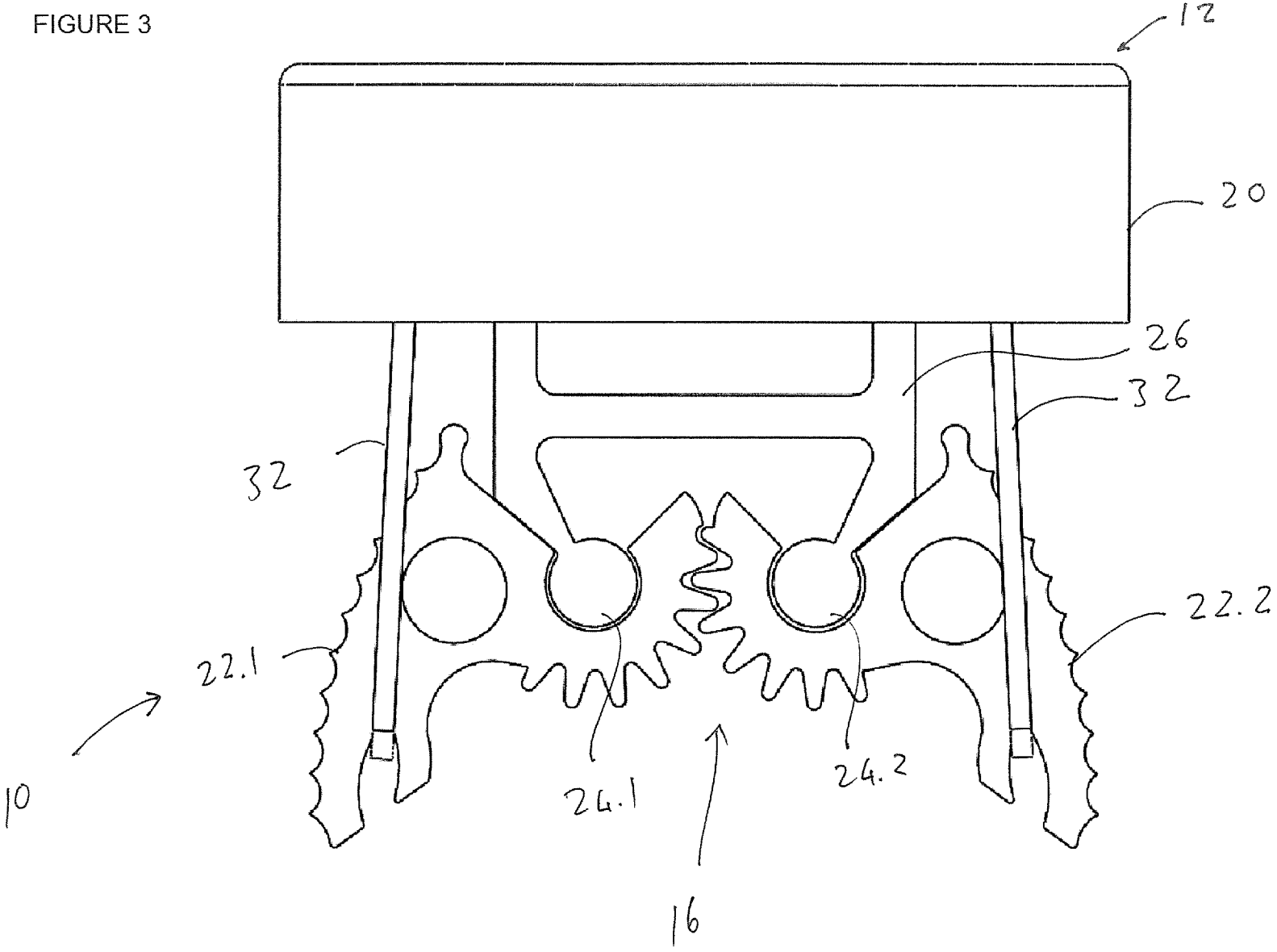
FIG. 3 is a side view of the embodiment shown in FIGS. 1 and 2.
Figure 4:
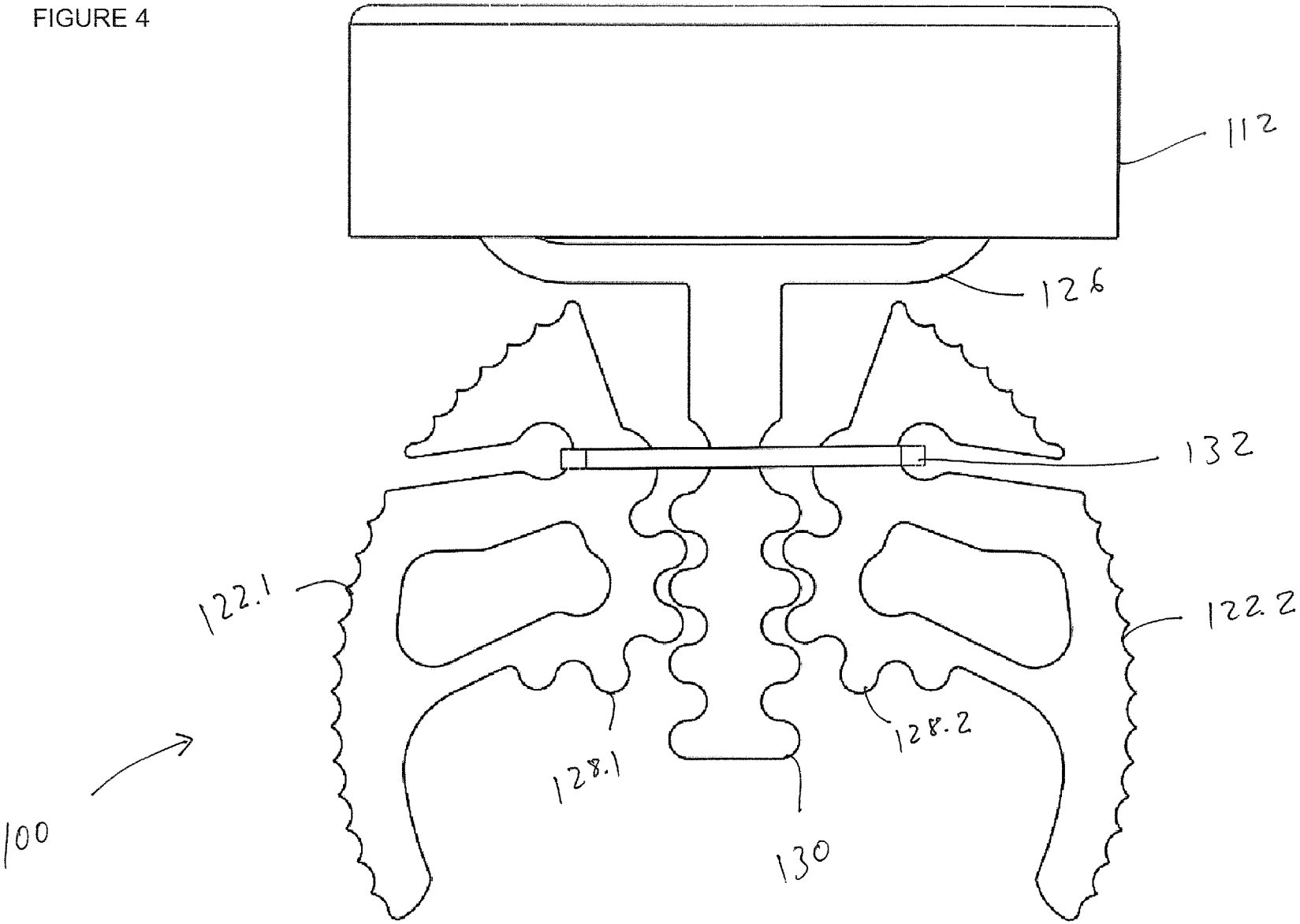
FIG. 4 is a side view of a second embodiment of the adjuster.
Figure 5:
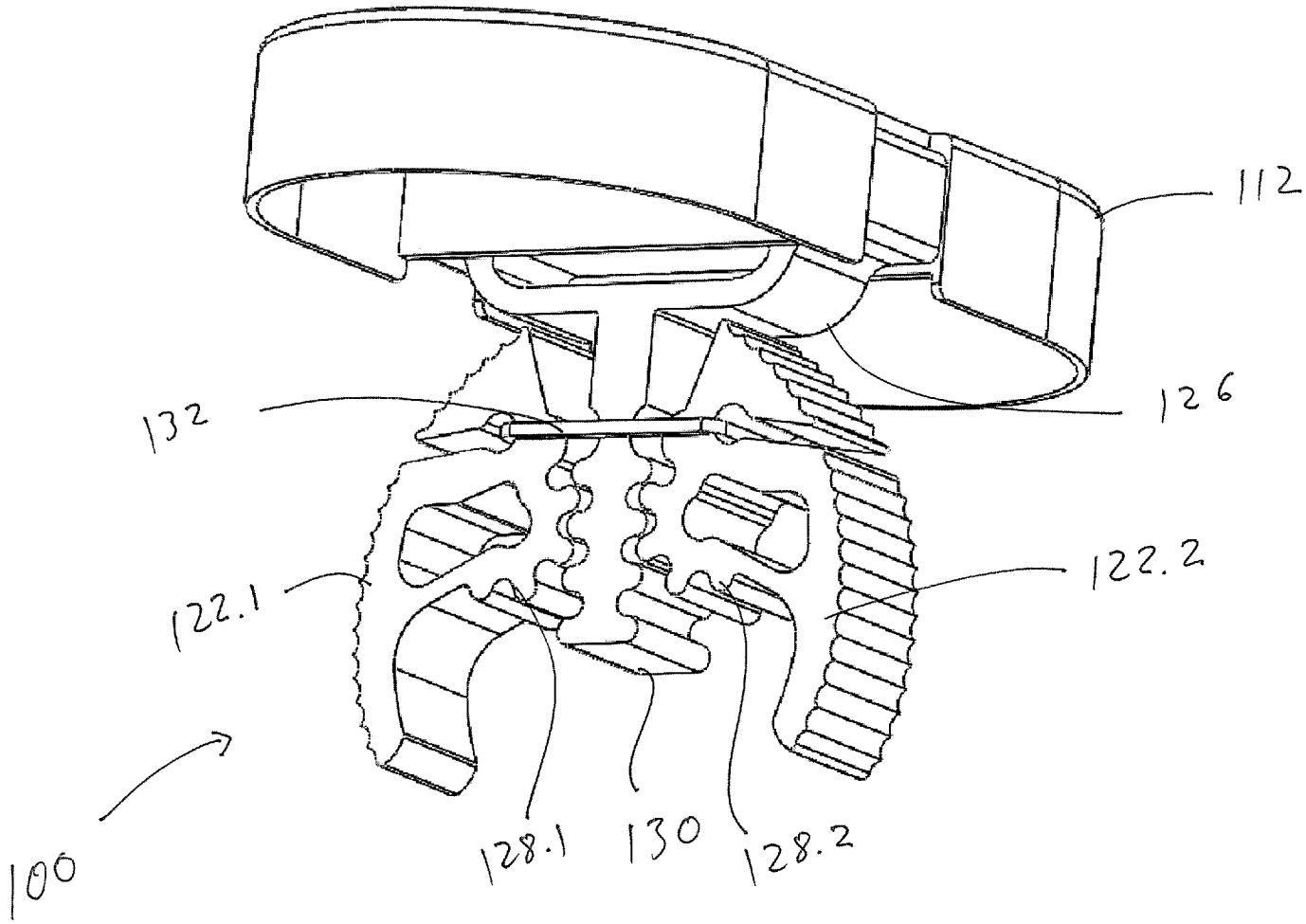
FIG. 5 is a bottom perspective view of the embodiment shown in FIG. 4.

FIGS. 1 to 3 depicts adjuster 10 which includes a floor 12 dimensioned to be complementary received by the receptacle 14 and a displacement mechanism 16 for displacing the floor 12 relative the receptacle 14, wherein the volume of the receptacle 14 is adjusted when actuating the displacement mechanism 16 allowing displacement of the floor 12 relative the said receptacle 14.

Receptacle 14 can be oval shaped in top view and manufactured from a biodegradable material which can further include starch and/or a derivative thereof.

Receptacle 14 is further resiliently deformable and/or elastic so as to allow actuating of the displacement mechanism from outer the receptacle 14.

Receptacle 14 can further include a bottom portion for sealing off the bottom end of thereof.

Floor 12 will typically have an outer circumference shaped and sized to allow the floor 12 to fit snugly inside the receptacle 14.

Floor 12 further includes a food receiving zone 18 defined onto an upper facing surface thereof which can be corrugated and/or serrated.

Floor 12 further include a stabiliser 20 for inhibiting angular movement relative a vertical axis thereof when displacing the floor 12 relative the receptacle 14. Stabiliser 20 is in the form of a flange extending circumferentially about the floor 12 and extending downward therefrom.

The displacement mechanism 16 is further configured to allow linear displacement of the floor 12 relative the receptacle 14 and when actuated, displace the floor 12 towards an upper end region of the receptacle 14 for decreasing the volume thereof.

Displacement mechanism 16 includes a pair of arms 22.1 and 22.2, and a biasing mechanism for biasing the arms 22.1 and 22.2 towards an extended outward position.

In the first embodiment of the invention depicted in FIGS. 1 to 3, arms 22.1 and 22.2 are pivotally connected to the floor 12, opposedly one another and pivoting about a pair of pivot points 24.1 and 24.2 defined by a connecting arrangement 26 interconnecting the displacement mechanism 16 and the floor 12. The pair of pivot points 24.1 and 24.2 includes a pair of shafts defined on the connecting arrangement 26, and a bore defined on an end region of each arm for pivotally mounting the arms 22.1 and 22.2 onto the shafts, respectively.

A synchronising mechanism is further provided in order to synchronise the degree of pivotal displacement of one arm 22.1 relative arm 22.1 when actuated.

In the first embodiment the synchronising mechanism is in the form of a cogwheel type formations 28.1 and 28.2 defined on opposing end regions of arms 22.1 and 22.2, about the pivot points 24.1 and 24.2, wherein the pivot points are arranged so as to allow the cogwheel type formation 28.1 of arm 22.1 to mesh with the cogwheel type formation 28.2 of arm 22.2.

The meshing arrangement of the cogwheel type formations 28.1 and 28.2 enables the pair of arms 22, when actuated, to be displaced in unison or synchronously relative one other, thereby promoting an even degree of displacement of opposing sides of the floor 12 so as to maintain all sides of the floor 12 in a substantial orthogonal relationship relative the receptacle 14, when in operative mode.

Biasing of the arms 22.1 and 22.2 outward towards an outward extended condition wherein distally defined operative surfaces of the arms 22.1 and 22.2 abut against the inner surface of the receptacle 14 is achieved by the mounting of a spring-loaded plate 30 interconnectably onto lower end regions of the arms 22.1 and 22.2 for biasing opposing the lower end regions away from one another towards and extend position.

In FIG. 2 the biasing mechanism is in the form of a pair of elastic bands 32, arranged to interconnect lower end regions of each arm 22,1 and 22.1 and the connecting arrangement 26, pulling the distal end regions of the arms away from one another pivoting about the pivot points.

In a second embodiment of the invention depicted by numeral 100 the synchronising mechanism includes a linear geared shaft 130 extending downward from the connecting arrangement 126, wherein the cogwheel type formation 128.1 and 128.2 of each arm 122.1 and 122.2 is arranged to operatively interconnect with the linear geared shaft 130. In this form of the invention actuating arms 122.1 and 122.2 pushes the linear geared shaft 130 in an upward direction, displacing the floor 112 upwardly and reducing the volume of the receptacle.

In this embodiment the biasing mechanism takes the form of an elastic 132 interconnecting upper end regions of the arms 122.1 and 122.2.

Each pair of the pair of arms 22 and 122 are further arcuated shaped in side view so as to allow operative surfaces thereof to remain in contact with the receptacle when the operative surfaces of the arms are actuated towards an inclined position towards one another.

The operative surfaces further include serrations to provide gripping against the receptacle when in operative mode.

The invention claimed is:

1. An adjuster for adjusting a volume of a receptacle which includes:

a floor dimensioned to be complementary received by the receptacle;

a displacement mechanism for displacing the floor towards an upper end region of the receptacle and thereby decreasing the volume of the receptacle when the displacement mechanism is actuated;

the displacement mechanism comprising:

a pair of operatively interconnected arcuate shaped arms in side view;

a biasing mechanism for biasing distally defined operative surfaces of the pair of arms outward towards abutment with an inner surface of the receptacle; and a synchronising mechanism for synchronising degree of pivotal displacement of the pair of arms relative one another.

2. An adjuster as claimed in claim 1 wherein the receptacle is circular shaped in top view.

3. An adjuster as claimed in claim 1 wherein the receptacle is oval shaped in top view.

4. An adjuster as claimed in claim 1 wherein the receptacle is manufactured from a biodegradable material.

5. An adjuster as claimed in claim 1 wherein the receptacle is resiliently deformable.

6. An adjuster as claimed in claim 1 wherein the receptacle includes a bottom portion for sealing off the bottom end of thereof.

7. An adjuster as claimed in claim 1 wherein the floor has an outer circumference shaped and sized to allow the floor to fit snugly inside the receptacle.

8. An adjuster as claimed in claim 1 wherein the floor includes a food receiving zone defined onto an upper facing surface thereof.

9. An adjuster as claimed in claim 8 wherein the food receiving zone is corrugated.

10. An adjuster as claimed in claim 1 wherein the floor includes a stabiliser for inhibiting angular movement relative a vertical axis thereof when displacing the floor relative the receptacle.

11. An adjuster as claimed in claim 10 wherein the stabiliser is in the form of a flange extending circumferentially about the floor and extending downward therefrom.

12. An adjuster as claimed in claim 1 wherein the displacement mechanism is configured to allow linear displacement of the floor relative the receptacle.

13. An adjuster as claimed in claim 1 wherein the pair of arms is pivotally connected to the floor, opposedly one another and pivoting about a pair of pivot points defined by a connecting arrangement interconnecting the displacement mechanism and the floor.

14. An adjuster as claimed in claim 13 wherein the synchronising mechanism is in the form of a cogwheel type formation defined on opposing end regions of each arm about the pivot points, wherein the pair of pivot points is arranged so as to allow the cogwheel type formation of one arm to mes with the cogwheel type formation of the other arm.

15. An adjuster as claimed in claim 13 wherein the synchronising mechanism includes a linear geared shaft extending downward from the connecting formation, wherein the cogwheel type formation of each arm is arranged to operatively interconnect with the linear geared shaft.

16. An adjuster as claimed in claim 1 wherein the biasing mechanism is selected from any one or more of the group consisting of a spring-loaded plate, coil spring, and elastic band.

17. An adjuster as claimed in claim 1 wherein the biasing mechanism is mounted so as to interconnect upper end regions of the arms.

18. An adjuster as claimed in claim 1 wherein the biasing mechanism is mounted so as to interconnect lower end regions of each arm with the connecting formation, respectively.

19. An adjuster as claimed in claim 1 wherein the biasing mechanism is mounted so as to interconnect lower end regions of the arms.

20. An adjuster as claimed in claim 1 wherein the arms are arcuate shaped in side view so as to allow operative surfaces thereof to remain in contact with the receptacle when the arms are actuated towards an inclined position towards one another.

21. An adjuster as claimed in claim 1 wherein the operative surfaces of each arm includes serrations.

* * * * *